US010240842B2

(12) United States Patent
Miller

(10) Patent No.: US 10,240,842 B2
(45) Date of Patent: Mar. 26, 2019

(54) ICE MAKING APPLIANCE AND APPARATUS

(71) Applicant: Haier US Appliance Solutions, Inc., Wilmington, DE (US)

(72) Inventor: Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 307 days.

(21) Appl. No.: 15/208,673

(22) Filed: Jul. 13, 2016

(65) Prior Publication Data

US 2018/0017306 A1 Jan. 18, 2018

(51) Int. Cl.
*F25C 1/147* (2018.01)
*F25D 17/06* (2006.01)

(52) U.S. Cl.
CPC ..... *F25C 1/147* (2013.01); *F25D 17/065* (2013.01); *F25D 2317/067* (2013.01)

(58) Field of Classification Search
CPC .... F25C 1/147; F25C 1/22; F25C 5/22; F25C 1/04; F25C 1/06; F25C 1/145; F25D 2317/067
USPC ..... 62/320
See application file for complete search history.

(56) References Cited

U.S. PATENT DOCUMENTS 6,286,332 B1 9/2001 Goldstein
2001/0045275 A1* 11/2001 Banno ..... F25C 1/147 165/169
2013/0276472 A1* 10/2013 Mitchell ..... F25C 1/147 62/344
2014/0000303 A1* 1/2014 Jeong ..... F25C 5/007 62/344
2014/0245774 A1* 9/2014 Maroli ..... F25C 1/147 62/346
2015/0128633 A1* 5/2015 Mitchell ..... F25C 1/147 62/344
2016/0054043 A1* 2/2016 Broadbent ..... F25C 1/25 62/66

FOREIGN PATENT DOCUMENTS

DE 102011075566 A1 11/2012

* cited by examiner

*Primary Examiner* — Frantz Jules
*Assistant Examiner* — Steve Tanenbaum
(74) *Attorney, Agent, or Firm* — Dority & Manning, P.A.

(57) ABSTRACT

An ice maker apparatus is provided that may include a casing, an extruder die, an auger, a heat exchange body, and a fin portion. The casing may define a chamber about a central axis and extend along the central axis between a top portion and a bottom portion. The extruder die may be mounted to the casing at the top portion of the casing. The auger may be disposed within the chamber. The heat exchange body may be disposed in thermal engagement with the chamber. The heat exchange body may include a base wall extending along a portion of the casing and a sidewall extending outward from the base wall. The heat exchange body may also define an air duct across the base wall and sidewall. The fin portion may include a fin extending outward from the base wall. The fin may define a plurality of subchannels.

16 Claims, 11 Drawing Sheets

ICE MAKING APPLIANCE AND APPARATUS

FIELD OF THE INVENTION

The present subject matter relates generally to refrigeration appliances, and more particularly to refrigeration appliances including features for making ice.

BACKGROUND OF THE INVENTION

Certain appliances, such as refrigerator appliances, include an ice maker. In order to produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

During ice making operations, heat is generally conducted away from water within the mold body. Some ice makers use a liquid cooling system to draw heat from the mold body. However, such systems may be difficult to assemble and/or repair. Moreover, it is possible that a portion of the liquid cooling system may leak if it is not properly maintained. Although some air-cooled systems exist, large amounts of energy are often required to ensure an adequate heat exchange.

Accordingly, ice maker assemblies with features for rapidly cooling or drawing heat from water to be frozen would be useful. It would be further useful if such assemblies were able to use air as a heat exchange medium while still minimizing the energy used to freeze ice nuggets.

BRIEF DESCRIPTION OF THE INVENTION

Aspects and advantages of the invention will be set forth in part in the following description, or may be obvious from the description, or may be learned through practice of the invention.

In one aspect of the present disclosure, an ice maker apparatus is provided. The ice maker apparatus may include a casing, an extruder die, an auger, a heat exchange body, and a fin portion. The casing may define a chamber about a central axis and extend along the central axis between a top portion and a bottom portion. The extruder die may be mounted to the casing at the top portion of the casing. The auger may be disposed within the chamber of the casing. The heat exchange body may be disposed in thermal engagement with the chamber. The heat exchange body may include a base wall extending along a portion of the casing and a sidewall extending outward from the base wall. The heat exchange body may also define an air duct across the base wall and sidewall. The fin portion may include a fin extending outward from the base wall. The fin may define a plurality of subchannels within the air duct.

In another aspect of the present disclosure, a refrigerator appliance is provided. The refrigerator appliance may include a housing, and an ice maker. The housing may define a chilled chamber. The ice maker may be disposed within the housing. The ice maker may include a casing, an extruder die, an auger, a heat exchange body, and a fin portion. The casing may define a chamber about a central axis and extend along the central axis between a top portion and a bottom portion. The extruder die may be mounted to the casing at the top portion of the casing. The auger may be disposed within the chamber of the casing. The heat exchange body may be disposed in thermal engagement with the chamber. The heat exchange body may include a base wall extending along a portion of the casing and a sidewall extending outward from the base wall. The heat exchange body may define an air duct across by the base wall and sidewall. The fin portion may include a fin extending outward from the base wall. The fin may define a plurality of subchannels within the air duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
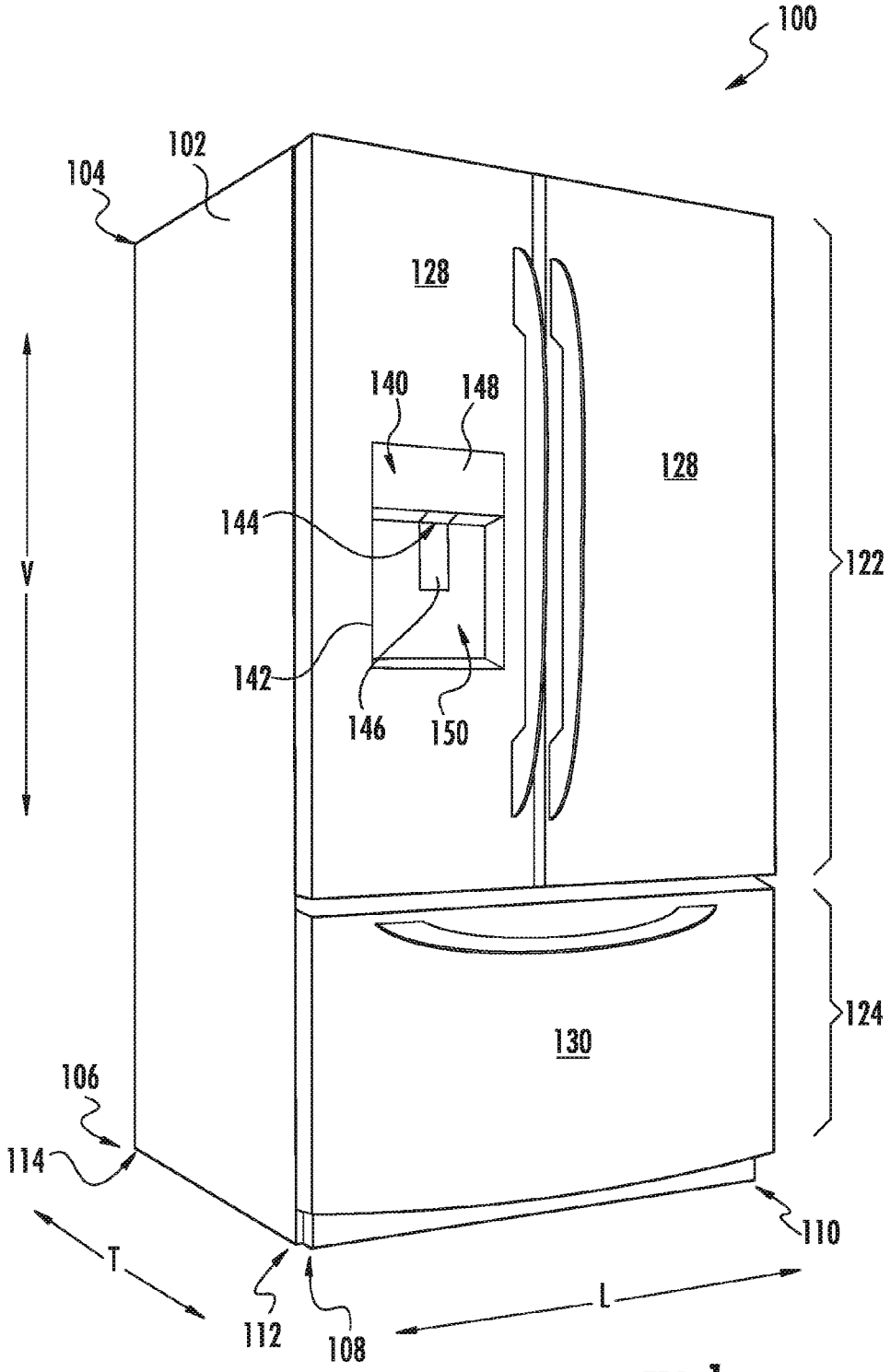
FIG. 1 provides a perspective view of a refrigerator appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present subject matter provides an ice making assembly that includes an air cooled nugget icemaker. The icemaker may have a heat exchange body and one or more fins. A passage cover may enclose the heat exchange body and fin(s). The passage cover, heat exchange body, and fin(s) may define isolated air ducts or channels that advantageously direct air across the icemaker without unduly increasing air pressure.

Figure 2:
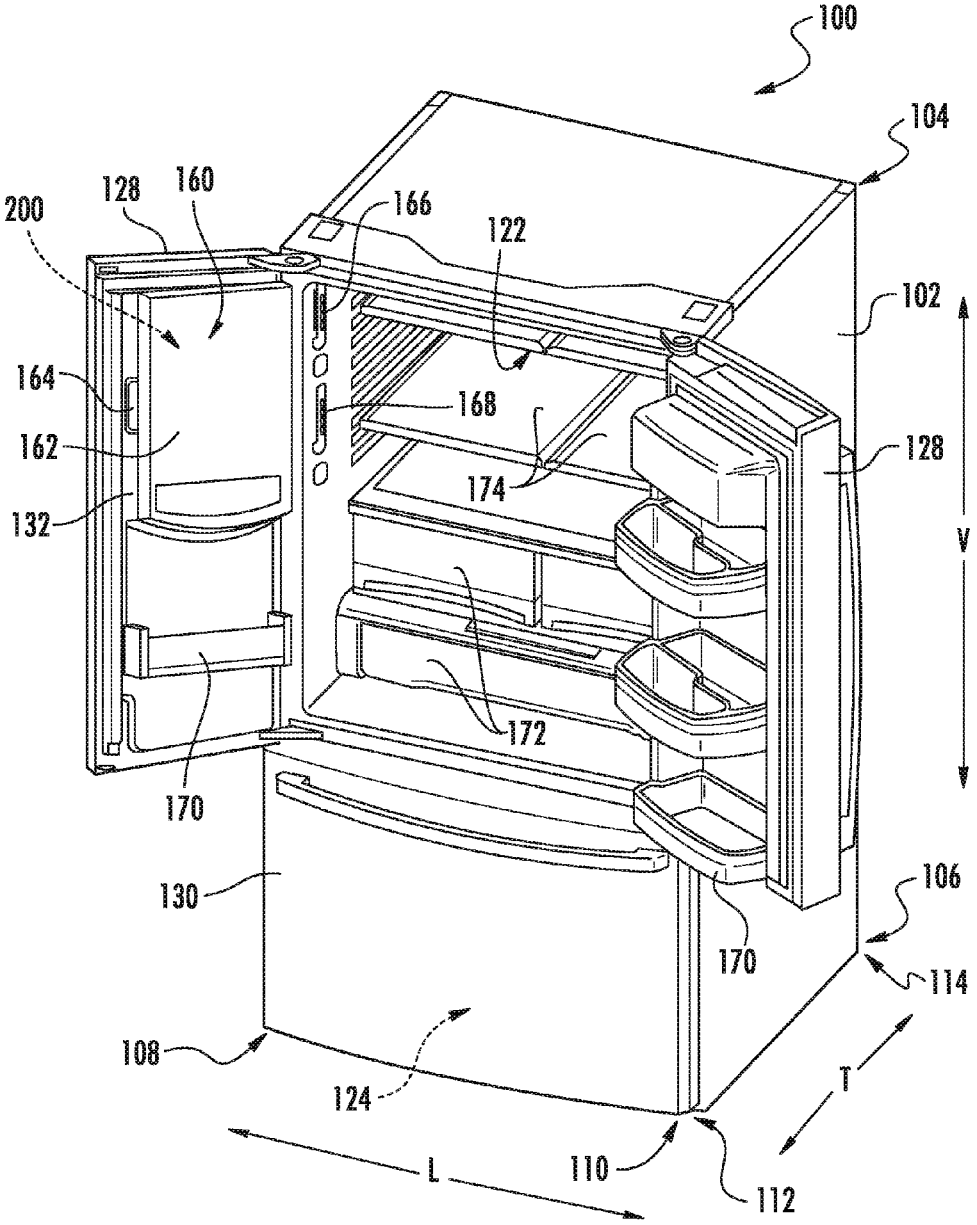
FIG. 2 provides a perspective view of the exemplary refrigerator appliance shown in FIG. 1, wherein a refrigerator door is in an open position according to an exemplary embodiment of the present disclosure.
Figure 3:
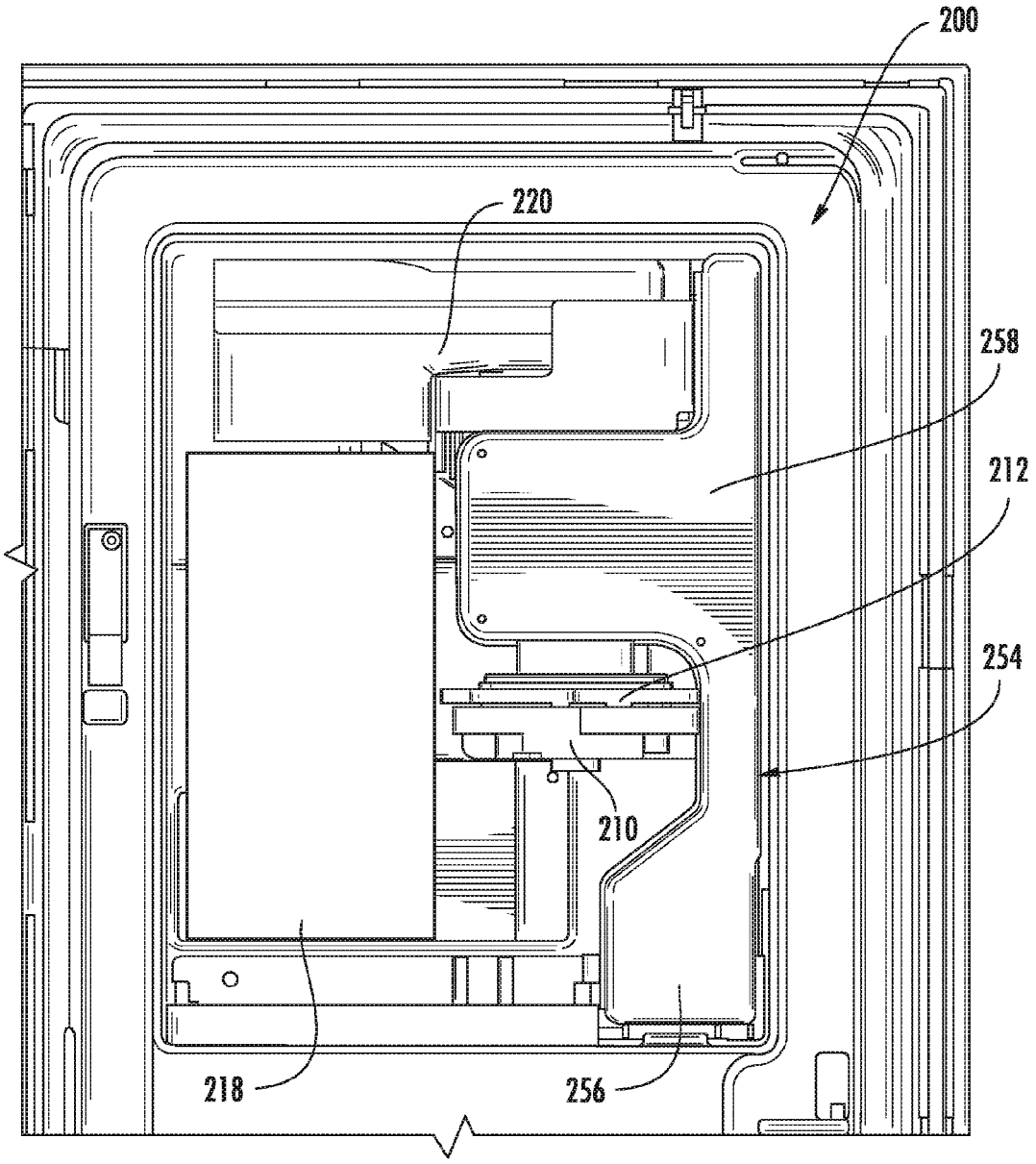
FIG. 3 provides a perspective view of an internal portion of a refrigerator door of an exemplary refrigerator appliance embodiment, including an ice making assembly.
Figure 4:
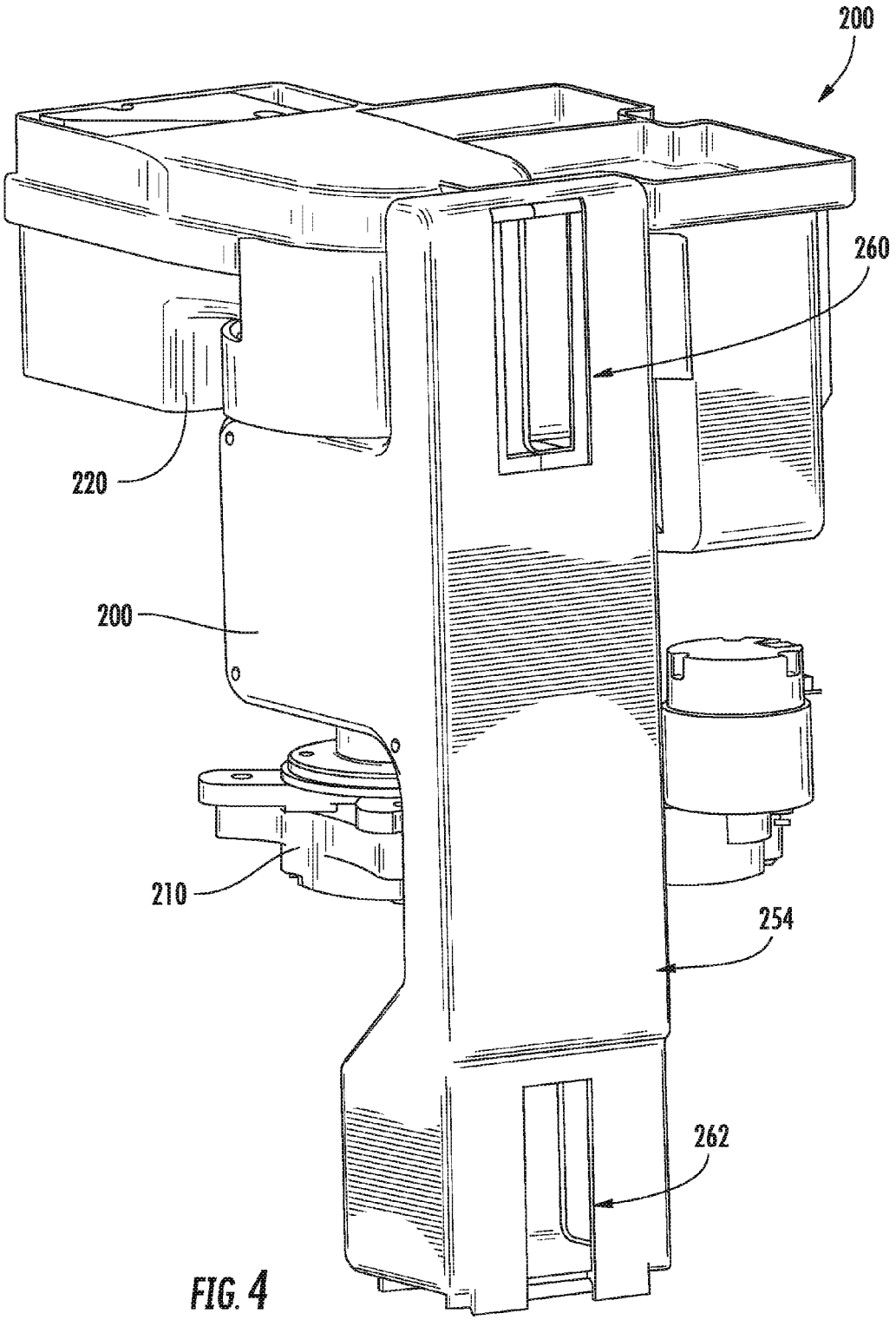
FIG. 4 provides a perspective view of the exemplary ice making assembly embodiment of FIG. 3.
Figure 5:
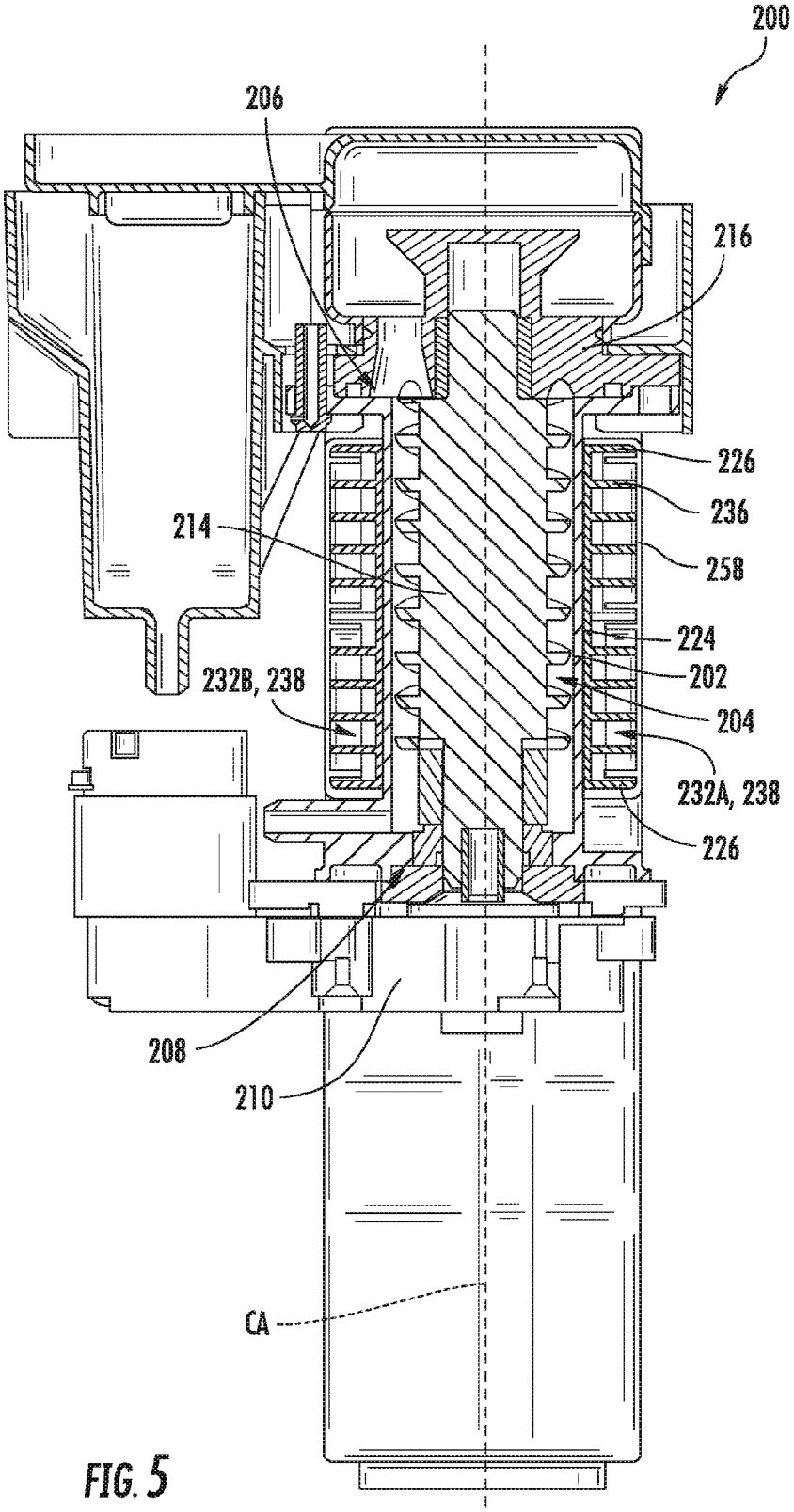
FIG. 5 provides a cross-sectional side view of the exemplary ice making assembly embodiment of FIG. 3.
Figure 6:
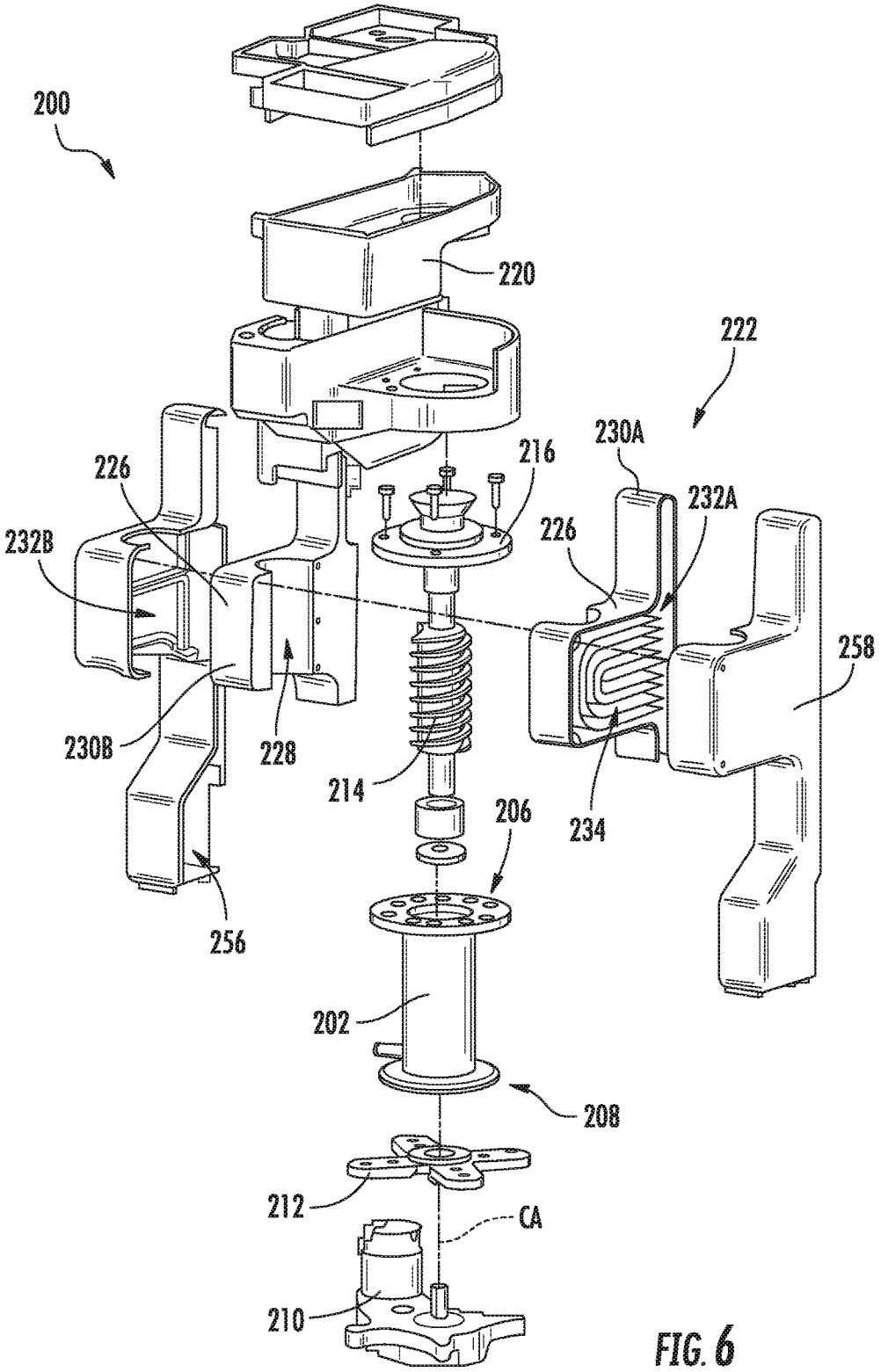
FIG. 6 provides an exploded perspective view of the exemplary ice making assembly embodiment of FIG. 3.

Turning to the figures, FIGS. 1 and 2 illustrate a perspective view of an exemplary appliance, e.g., a refrigerator appliance 100, that includes an ice making feature. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another. Although shown as a refrigerator appliance 100, it is noted that another appliance, such as a stand-alone ice maker, may be provided without departing from the scope of the present disclosure.

As shown, housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages and/or solid food items) and may assist with organizing such food items. As an example, drawers 172 can receive fresh food items (e.g., vegetables, fruits, and/or cheeses) and increase the useful life of such fresh food items.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a delivery assembly 140 for delivering or dispensing liquid water and/or ice. Delivery assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. As described in more detail below, the dispensing assembly 140 may receive ice from an icemaker disposed in a sub-compartment of the fresh food chamber 122.

FIG. 2 provides a perspective view of a door of refrigerator appliance 100 shown with refrigerator doors 128 in the open position. As shown, at least one door 128 includes a door liner 132 defining a sub-compartment, e.g., icebox compartment 160. Icebox compartment 160 extends into fresh food chamber 122 when refrigerator door 128 is in the closed position. Although icebox compartment 160 is shown in door 128, additional or alternative embodiments may include an icebox compartment defined within door 130. As discussed in greater detail below, an ice making assembly or icemaker 200 may be positioned or disposed within icebox compartment 160. Ice may be supplied to dispenser recess 150 (see FIG. 1) from the icemaker 200 in icebox compartment 160 on a back side of refrigerator door 128.

Figure 7:
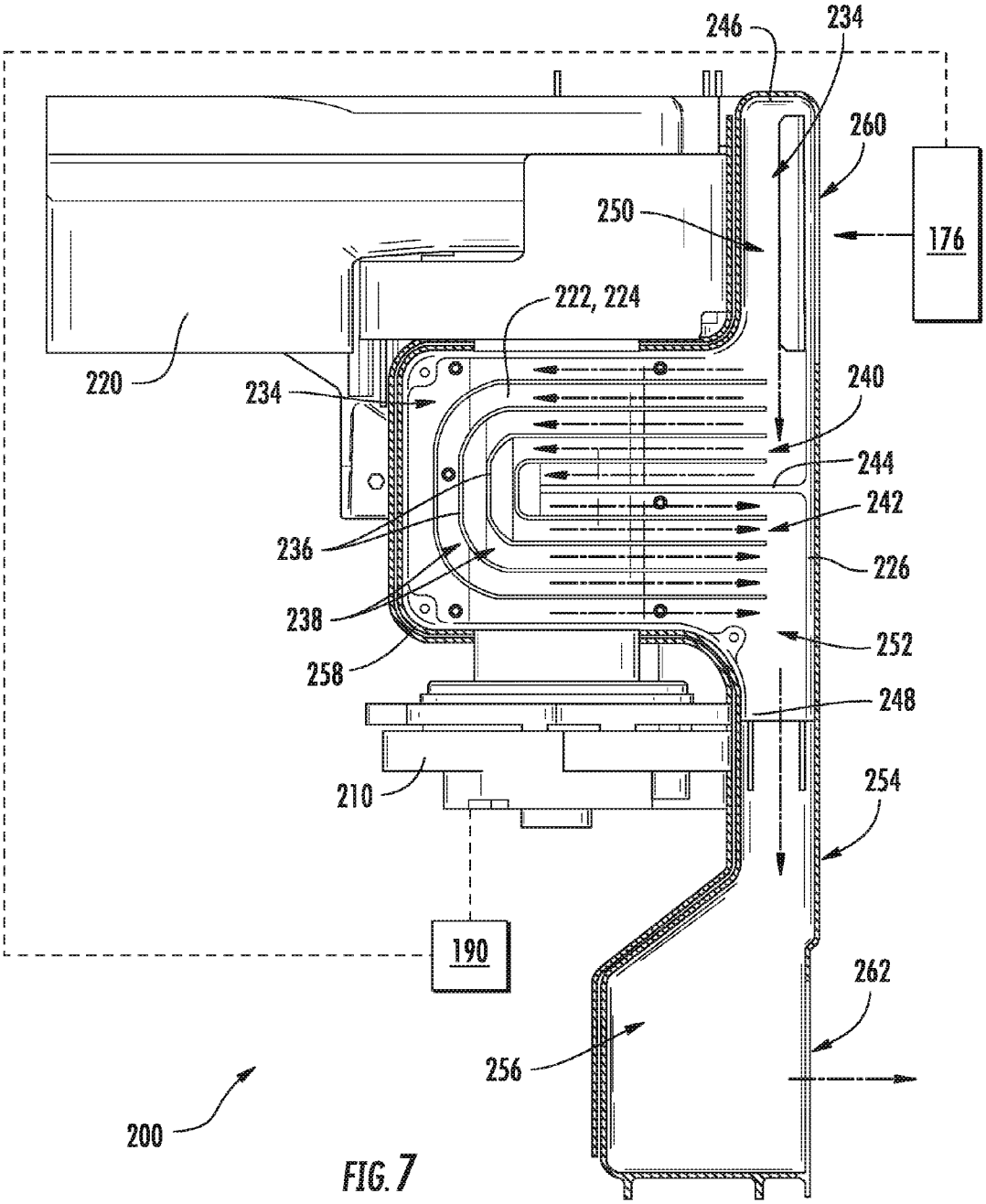
FIG. 7 provides a cross-sectional front view of the exemplary ice making assembly embodiment of FIG. 3.
Figure 8:
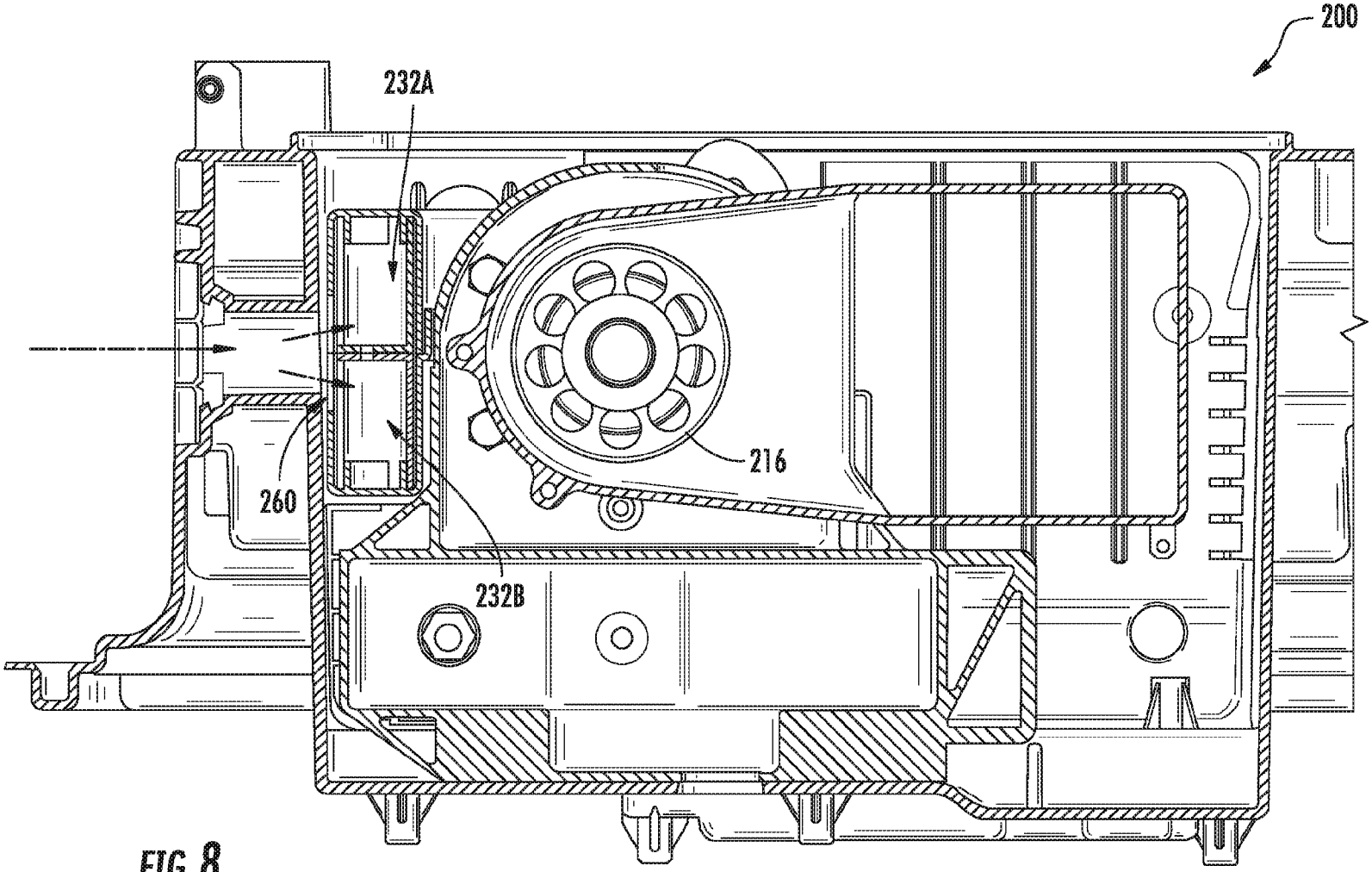
FIG. 8 provides a cross-sectional top view of the exemplary ice making assembly embodiment of FIG. 3.
Figure 9:
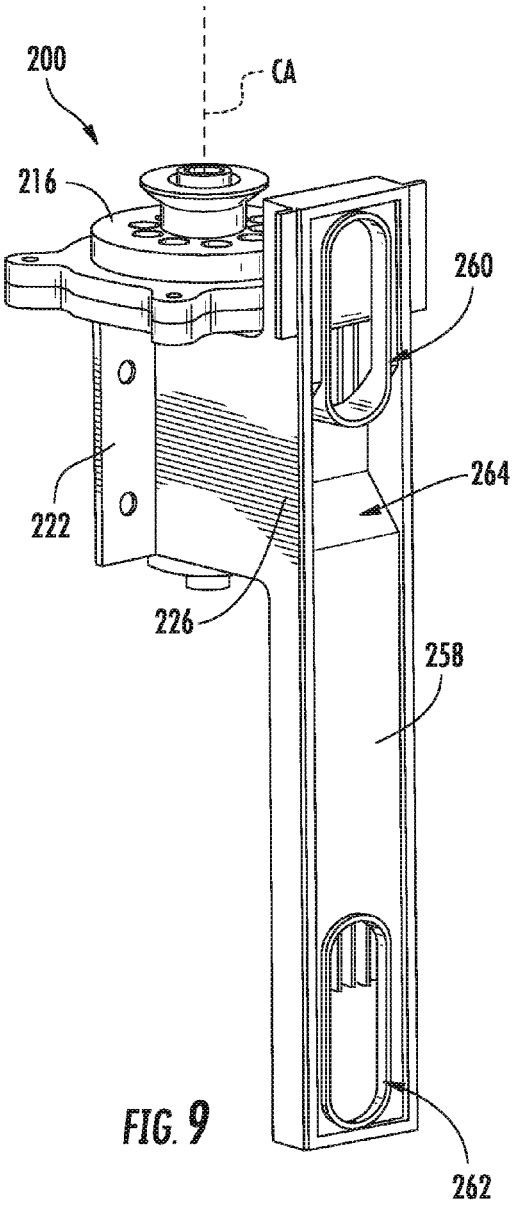
FIG. 9 provides a perspective view of another exemplary ice making assembly embodiment.
Figure 10:
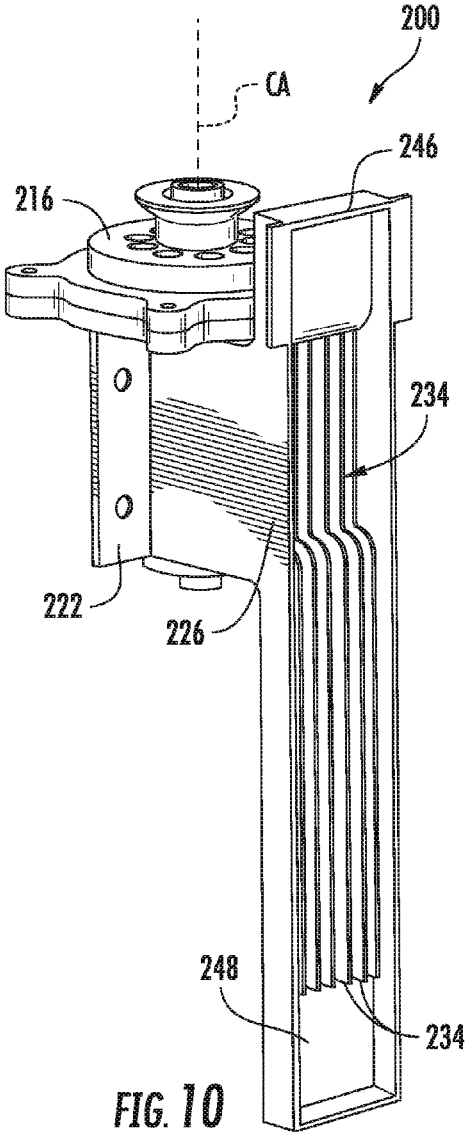
FIG. 10 provides a perspective view of the exemplary ice making assembly embodiment of FIG. 9, wherein a passage cover has been removed.
Figure 11:
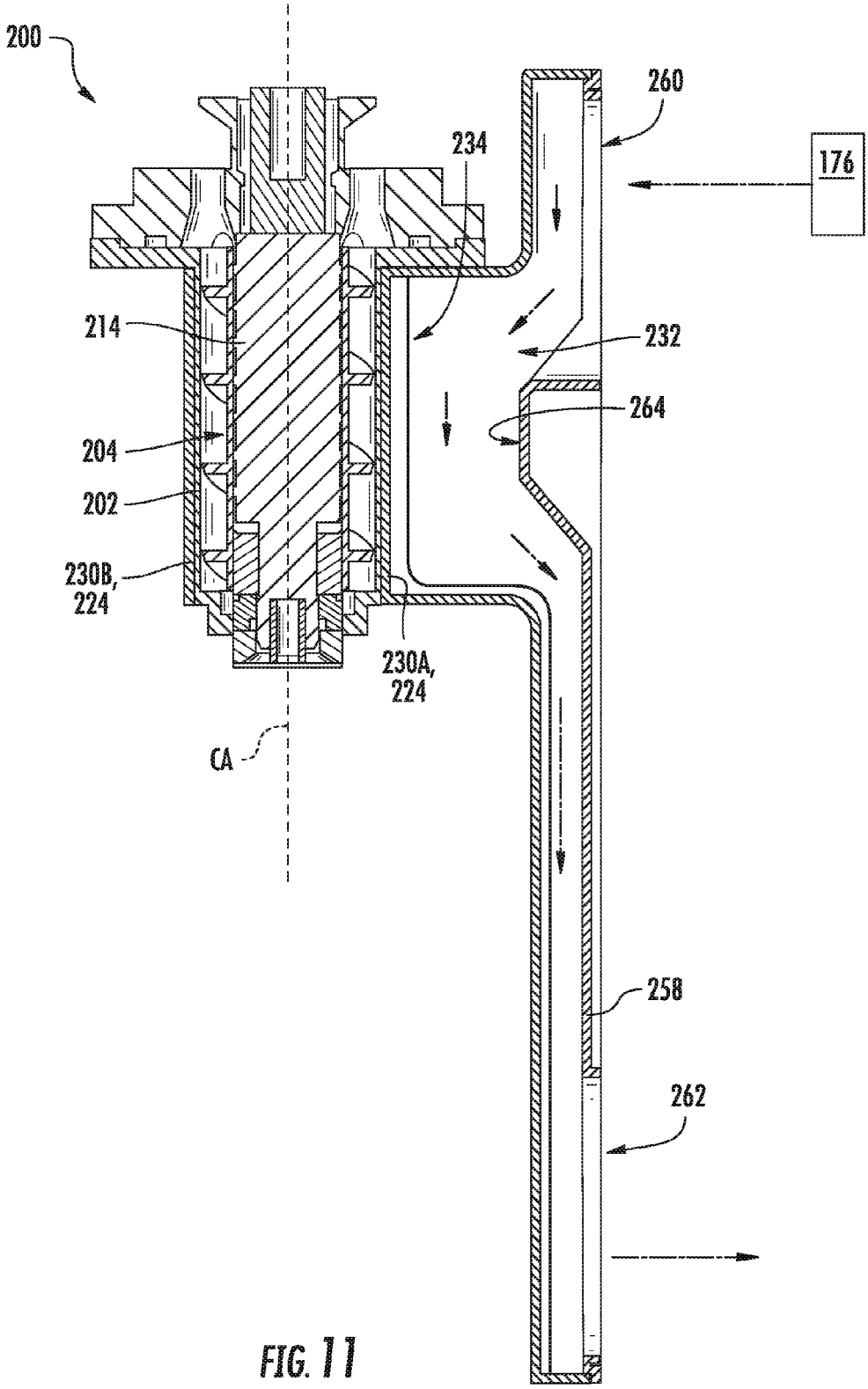
FIG. 11 provides a cross-sectional front view of the exemplary ice making assembly embodiment of FIG. 9.
Figure 12:
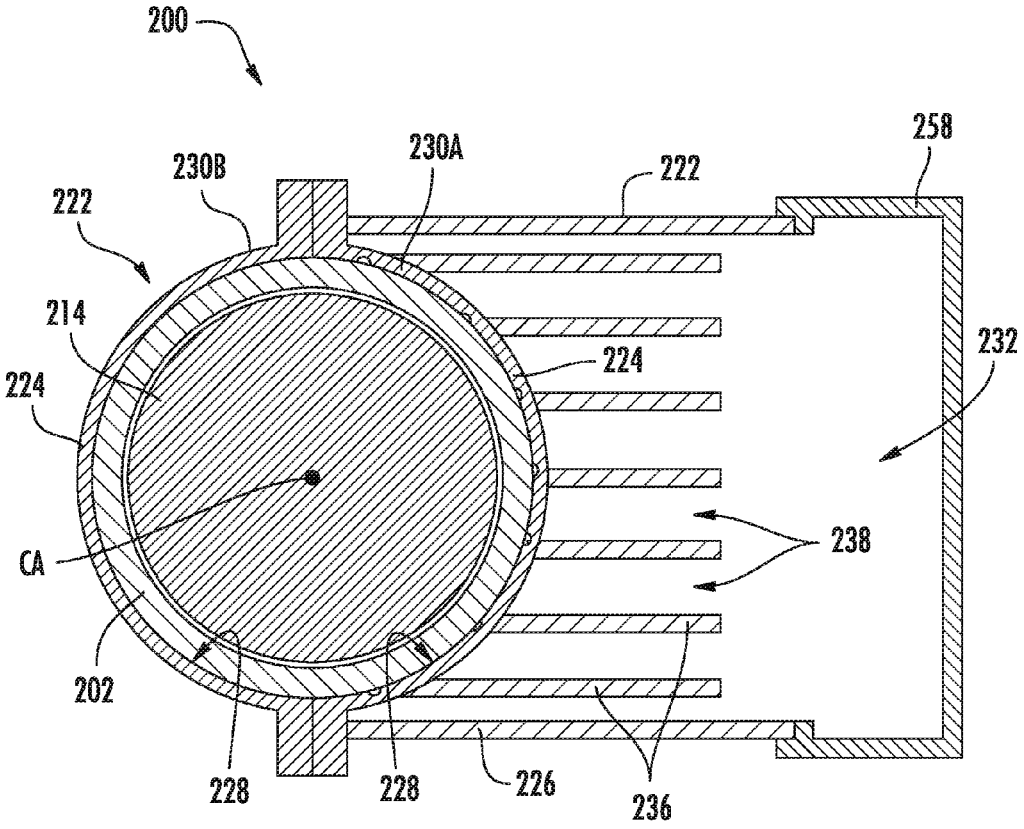
FIG. 12 provides a schematic cross-sectional top view of the exemplary ice making assembly embodiment of FIG. 9.

An access door—e.g., icebox door 162—may be hinged to icebox compartment 160 to selectively cover or permit access to opening of icebox compartment 160. Icebox door 162 permits selective access to icebox compartment 160. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160, e.g., by thermally isolating or insulating icebox compartment 160 from fresh food chamber 122. Icebox compartment 160 may receive cooling air from a chilled air supply duct 166 and a chilled air return duct 168 disposed on a side portion of housing 102 of refrigerator appliance 100. In this manner, the supply duct 166 and return duct 168 may recirculate chilled air from a suitable sealed cooling system through icebox compartment 160. An air handler 176 (see FIG. 7), such as a fan or blower, may be provided to motivate and recirculate air. As an example, air handler 176 can direct chilled air from an evaporator of a sealed system through a duct to compartment 160.

Turning to FIGS. 3 through 8, ice making assembly 200 is positioned or disposed within sub-compartment 160. Ice making assembly 200 includes a mold body or casing 202. Casing 202 defines a chamber 204 enclosed about a central axis CA. As shown, casing 202 extends along the central axis CA between a top portion 206 and a bottom portion 208. An auger 214 is rotatably mounted within chamber 204 and casing 202. A motor 210 is mounted to casing 202 and is disposed in mechanical communication with (e.g., operably connected or coupled to) auger 214. Motor 210 is attached to the casing 202 below the bottom portion 208, e.g., at a discrete mounting bracket 212. Motor 210 is configured for selectively rotating auger 214 in the mold body within casing 202. During rotation of auger 214 within the mold body, auger 214 scrapes or removes ice off an inner surface of the mold body within casing 202 and directs such ice to an extruder die 216. Extruder die 216 is mounted to casing 202 at the top portion 206 of casing 202. At extruder die 216, ice nuggets are formed from ice within casing 202. In some embodiments, an ice bucket or ice storage bin 218 is positioned below extruder die 216 and receives the ice nuggets from extruder die 216. For instance, an ice chute 220 may be positioned adjacent to extruder die 216 to direct ice from extruder die 216 to ice bin 218. From ice storage bin 218, the ice nuggets can enter delivery assembly 140 and be accessed by a user as discussed above. In such a manner, ice making assembly 200 can produce or generate ice nuggets.

Operation of ice making assembly 200 is controlled by a processing device or controller 190, e.g., that may be operatively coupled to control panel 148 for user manipulation to select features and operations of ice making assembly 200. Controller 190 can operate various components of ice making assembly 200 to execute selected system cycles and features. For example, controller 190 is in operative communication with motor 210 and air handler 176. Thus, controller 190 can selectively activate and operate motor 210 and air handler 176 according to one or more desired operations.

Controller 190 may include a memory and microprocessor, such as a general or special purpose microprocessor operable to execute programming instructions or micro-control code associated with operation of ice making assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 210 and air handler 176 may be in communication with controller 190 via one or more signal lines or shared communication busses.

As illustrated, exemplary embodiments of ice making assembly 200 include a heat exchange body 222 disposed in thermal engagement with chamber 204. Generally, heat exchange body 222 includes a base wall 224 that extends along a portion of the casing 202 and a sidewall 226 that extends outward from base wall 224. Base wall 224 and sidewall 226 may substantially enclose all or some of casing 202. Base wall 224 may be connected to casing 202, e.g., in conductive thermal engagement. For instance, base wall 224 may physically engage casing 202 such that heat is conducted between casing 202 and base wall 224, e.g., at an interior surface 228 of base wall 224. In some such embodiments, a thermal paste, such as a silicone-based thermal grease (e.g., CHEMPLEX 1381™) may be disposed between interior surface 228 and casing 202. In some embodiments, interior surface 228 is shaped to generally complement casing 202 in a mated connection. For instance, casing 202 may be formed as a generally cylindrical body while interior surface 228 is shaped as a cylindrical relief or void to receive the cylindrical body of casing 202. In additional or alternative embodiments, base wall 224 is integrally-attached or integrally-formed with casing 202 such that a base wall 224 and casing 202 form a single continuous piece of material, such as a suitable conductive metal (e.g., stainless steel).

In some embodiments, heat exchange body 222 includes two or more discrete members 230A, 230B. In exemplary embodiments, such as that illustrated in FIGS. 4 through 8, heat exchange body 222 includes a first body member 230A and a second body member 230B. Each body member 230A, 230B is a similar or mirrored half to the other. First body member 230A and second body member 230B may attach to each other. Optionally, first body member 230A and second body member 230B may be attached in a direct physical connection. Heat may be conducted between the body members 230A, 230B such that heat is evenly distributed about the chamber 204. One or more physical connectors (e.g., bolts, screws, clips, adhesives, etc.) may join the first and second members 230A, 230B, selectively fixing them to one another.

As shown, heat exchange body 222 defines one or more air duct 232 extending across the base wall 224 and sidewall 226. In exemplary embodiments, such as that illustrated in FIGS. 4 through 8, heat exchange body 222 defines two discrete air ducts 232A, 232B. Generally, the first air duct 232A is defined by first body member 230A, while second air duct 232B is defined by second body member 230B. The air ducts 232A & 232B may be defined parallel to each other. During ice making operations, air within each air duct 232A, 232B may be isolated and kept separate from the other.

Within air ducts 232A & 232B, one or more fin portions 234 may be provided. A fin portion 234 may include plurality of fins 236, such as radial fins, that extend outward from base wall 224, e.g., radially away from central axis CA, within air duct 232A, 232B. The radial fins 236 define a plurality of subchannels 238 within an air duct 232A, 232B. The subchannels 238 formed by radial fins 236 may advantageously control the flow of air across base wall 224 without unduly increasing air pressure. For instance, in exemplary embodiments, such as that illustrated in FIGS. 4 through 8, radial fins 236 are formed as a plurality of arcuate fins defining a plurality of C-shaped subchannels 238. The subchannels 238 are formed across a radial portion of base wall 224 and casing 202. Each subchannel 238 includes a channel inlet 240 and a channel outlet 242. Each channel inlet 240 and channel outlet 242 may be directed orthogonal to the central axis CA, e.g., such that the channel inlets 240 and channel outlets 242 are substantially horizontal. As shown, each channel inlet 240 is positioned above each channel outlet 242. Optionally, an intermediary fin 244 extends from sidewall 226 between the channel inlets 240 and the channel outlets 242.

As illustrated, the radial fins 236 are thermally engaged with base wall 224 and/or chamber 204, e.g., in conductive thermal engagement, to draw heat away from chamber 204. Each fin 236 is formed from a suitable conductive material. Moreover, each fin 236 may be integral to heat exchange body 222. In some such embodiments, the fin portion 234 integrally-attached or integrally-formed with base wall 224 such that each fin 236 and base wall 224 form a single continuous piece of material, such as a suitable conductive metal (e.g., aluminum). In optional embodiments, fins 236 and/or base wall 224 are formed from a distinct conductive metal from casing 202. For instance, casing may be formed from a corrosion-resistant metal (e.g., stainless steel) while fins 236 are formed from a different metal having superior thermal conductivity (e.g., aluminum).

In certain embodiments, one or more segments 246, 248 of heat exchange body 222 extend above and/or below casing 202. A top segment 246 may be provided as an extension of sidewall 226 and/or base wall 224 that is above the top portion 206 of casing 202. The top segment 246 may be substantially parallel to the central axis CA. Moreover, the top segment 246 may define a portion of an air duct 232 that is upstream from the radial fin portion 234. For instance, in some such embodiments, air duct 232 includes an upper channel 250 that is open to the plurality of subchannels 238 and is defined from the top segment 246 to the radial fins 236. Additionally or alternatively, a bottom segment 248 may be provided as an extension of sidewall 226 and/or base wall 224 that below the bottom portion 208 of casing 202. The bottom segment 248 may be substantially parallel to the central axis CA. Moreover, the bottom segment 248 may define a portion of an air duct 232 that is downstream from the radial fin portion 234. In some such embodiments, air duct 232 includes a lower channel 252 that is open to the plurality of subchannels 238 and is defined from the radial fins 236 to the bottom segment 248.

A passage cover 258 is attached to heat exchange body 222, e.g., at the sidewall 226. Passage cover 258 encloses at least a portion of heat exchange body 222, including an air duct 232. Moreover, passage cover 258 defines a discrete passage inlet 260 and passage outlet 262. When assembled, passage inlet 260 is positioned in upstream fluid communication with air duct 232 and passage outlet 262. Passage inlet 260 may be disposed between chilled air supply duct 166 (see FIG. 1) and channel inlet 240. Air directed from the housing 102 (see FIG. 2) may be guided through passage inlet 260 before reaching heat exchange body. Passage outlet 262 is positioned in downstream fluid communication with air duct 232. When assembled, passage outlet 262 may be disposed between chilled air return duct 168 (see FIG. 2) and channel outlet 242. Optionally, passage cover 258 may define a duct extension 254 in fluid communication between channel outlet 242 and passage outlet 262. Duct extension 254 may guide air from channel outlet 242 and to passage outlet 262 before it reaches chilled air return duct 168. In some such embodiments, an expansion chamber 256 is provided within duct extension 254, to further direct delivery of air to the housing 102.

Turning to FIGS. 9 through 12, an alternative embodiment of ice making assembly 200 is illustrated. As shown, base wall 224 and sidewall 226 define a single air duct 232 extending from a top segment 246 to a bottom segment 248. Base wall 224 is disposed about casing 202 and is provided in thermal engagement with chamber 204. Base wall 224 may physically engage casing 202 such that heat is conducted between casing 202 and base wall 224, e.g., at an interior surface 228 of base wall 224.

A radial fin portion 234, including a plurality of parallel radial fins 236, extends outward from base wall 224. Each fin 236 extends vertically along the central axis CA to define a plurality of subchannels 238. The radial fin portion 234 extends into a bottom segment 248 of sidewall 226 and base wall 224. A top segment 246 of sidewall 226 and base wall 224 extends above radial fin portion 234. In optional embodiments, radial fin portion 234 is exclusively provided on first body member 230A. Second body member 230B may be provided as a substantially arcuate member, e.g., such that base wall 224 of second body member 230B is one half of a cylindrical body. In some such embodiments, the interior surface 228 is tuned to conduct heat evenly across casing 202. For instance, a greater surface area of interior surface 228 may directly engage casing 202 in conductive thermal engagement at second body member 230B than at first body member 230A. The interior surface 228 at first body member 230A may be formed as an irregular (e.g., dimpled) surface while interior surface 228 at second body member 230B may be formed as a substantially smooth surface such that an equivalent amount of heat is exchanged with chamber 204 at the first body member 230A and the second body member 230B.

As shown, a passage cover 258 is attached to sidewall 226 and encloses air duct 232. Passage cover 258 defines a discrete passage inlet 260 and passage outlet 262. Passage inlet 260 is positioned in upstream fluid communication with air duct 232 and passage outlet 262. Passage outlet 262 is positioned in downstream fluid communication with air duct 232. An optional internal ridge 264 is provided on passage cover 258. As shown, internal ridge 264 forms a general wedge directing air toward radial fin portion 234 and casing 202 before air flows into bottom segment 248.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker apparatus comprising:

a casing defining a chamber about a central axis, the casing extending along the central axis between a top portion and a bottom portion;

an extruder die mounted to the casing at the top portion of the casing;

an auger disposed within the chamber of the casing;

a heat exchange body disposed in thermal engagement with the chamber, the heat exchange body including a base wall extending along a portion of the casing and a sidewall extending outward from the base wall, the heat exchange body defining an air duct across the base wall and sidewall; and a fin portion including a fin extending outward from the base wall, the fin defining a plurality of subchannels within the air duct, wherein the heat exchange body includes a first body member and a second body member attached in physical connection about the casing, wherein the air duct is a plurality of air ducts comprising a first air duct and a discrete second air duct, wherein the first air duct is defined by the first body member, and wherein the second air duct is defined by the second body member such that air within the second air duct is isolated from air within the first air duct.

2. The ice maker apparatus of claim 1, wherein the sidewall of the heat exchange body includes a top segment extending along the central axis above the top portion of the casing, and wherein the air duct includes an upper channel open to the plurality of subchannels and is defined from the top segment of the sidewall to the fin.

3. The ice maker apparatus of claim 1, wherein the sidewall of the heat exchange body includes a bottom segment extending along the central axis below the bottom portion of the casing, wherein the air duct includes a lower channel open to the plurality of subchannels and is defined from the fin to the bottom segment of the sidewall.

4. The ice maker apparatus of claim 1, further comprising a passage cover attached to the sidewall of the heat exchange body, the passage cover defining a passage inlet and a passage outlet, the passage inlet and the passage outlet being in fluid communication with the air duct.

5. The ice maker apparatus of claim 4, wherein the passage inlet is defined at position above the top portion of the casing, and wherein the passage outlet is defined at a position below the bottom portion of the casing.

6. The ice maker apparatus of claim 5, further comprising:

a sealed cooling system comprising a chilled air supply duct and a chilled air return duct, the chilled air supply duct and the chilled air return duct being in fluid communication with the air duct of the heat exchange body, wherein the sealed cooling system further comprises an air handler disposed in fluid communication with the chilled air supply duct and the chilled air return duct.

7. The ice maker apparatus of claim 1, further comprising a motor operably connected to the auger, wherein the motor is mounted below the bottom portion of the casing.

8. The ice maker apparatus of claim 1, wherein the fin portion includes a plurality of parallel arcuate fins defining a plurality of C-shaped subchannels across a portion of the casing, wherein each subchannel includes a channel inlet and a channel outlet, and wherein the channel inlet and the channel outlet are directed orthogonal to the central axis.

9. A refrigeration appliance comprising:

a housing defining a chilled chamber; and an ice maker disposed within the housing, the ice maker comprising a casing defining a chamber about a central axis, the casing extending along the central axis between a top portion and a bottom portion, an extruder die mounted to the casing at the top portion of the casing, an auger disposed within the chamber of the casing, a heat exchange body disposed in thermal engagement with the chamber, the heat exchange body including a base wall extending along a portion of the casing and a sidewall extending outward from the base wall, the heat exchange body defining an air duct across the base wall and sidewall, and a fin portion including a fin extending outward from the base wall, the fin defining a plurality of subchannels within the air duct, wherein the heat exchange body includes a first body member and a second body member attached in physical connection about the casing, wherein the air duct is a plurality of air ducts comprising a first air duct and a discrete second air duct, wherein the first air duct is defined by the first body member, and wherein the second air duct is defined by the second body member such that air within the second air duct is isolated from air within the first air duct.

10. The refrigeration appliance of claim 9, wherein the sidewall of the heat exchange body includes a top segment extending along the central axis above the top portion of the casing, and wherein the air duct includes an upper channel open to the plurality of subchannels and is defined from the top segment of the sidewall to the fin.

11. The refrigeration appliance of claim 9, wherein the sidewall of the heat exchange body includes a bottom segment extending along the central axis below the bottom portion of the casing, wherein the air duct includes a lower channel open to the plurality of subchannels and is defined from the fin to the bottom segment of the sidewall.

12. The refrigeration appliance of claim 9, further comprising a passage cover attached to the sidewall of the heat exchange body, the passage cover defining a passage inlet and a passage outlet, the passage inlet and the passage outlet being in fluid communication with the air duct.

13. The refrigeration appliance of claim 12, wherein the passage inlet is defined at position above the top portion of the casing, and wherein the passage outlet is defined at a position below the bottom portion of the casing.

14. The refrigeration appliance of claim 13, further comprising:

a sealed cooling system comprising a chilled air supply duct and a chilled air return duct, the chilled air supply duct and the chilled air return duct being in fluid communication with the air duct of the heat exchange body, wherein the sealed cooling system further comprises an air handler disposed within the housing in fluid communication with the chilled air supply duct and the chilled air return duct.

15. The refrigeration appliance of claim 9, further comprising a motor operably connected to the auger, wherein the motor is mounted below the bottom portion of the casing.

16. The refrigeration appliance of claim 9, wherein the fin portion includes a plurality of parallel arcuate fins defining a plurality of C-shaped subchannels across a radial portion of the casing, wherein each subchannel includes a channel inlet and a channel outlet, and wherein the channel inlet and the channel outlet are directed orthogonal to the central axis.

* * * * *